United States Patent [19]

Schmidt

[11] Patent Number: 4,806,232

[45] Date of Patent: Feb. 21, 1989

[54] METHOD FOR THE DESULPHURIZATION OF SULPHUR-CONTAINING FUELS AND FUEL DESULPHURIZED BY SAID METHOD

[75] Inventor: Rüdiger Schmidt, Munich, Fed. Rep. of Germany

[73] Assignee: Environment Protection Engineers Inc., Southfield, Mich.

[21] Appl. No.: 784,378

[22] Filed: Oct. 4, 1985

[30] Foreign Application Priority Data

Oct. 9, 1984 [DE] Fed. Rep. of Germany ..... 3437074

[51] Int. Cl.[4] ..... C10G 19/00

[52] U.S. Cl. ..... 208/226; 208/181; 208/244; 208/247; 208/248; 208/249

[58] Field of Search ..... 208/226, 181, 244, 247, 208/248, 249

[56] References Cited

U.S. PATENT DOCUMENTS

| | | | |
|---|---|---|---|
| 1,920,270 | 8/1933 | Morrell | 208/244 |
| 2,177,343 | 10/1939 | Hughes | 208/247 |
| 2,348,543 | 5/1944 | Johnson | 208/226 |
| 2,364,390 | 12/1944 | Schaafsma | 208/226 |
| 2,845,382 | 7/1958 | Leum et al. | 208/226 |
| 3,284,345 | 11/1966 | Ishiko et al. | 208/244 |
| 3,485,746 | 12/1969 | Setzer et al. | 208/244 |
| 3,807,090 | 4/1974 | Moss | 208/226 |
| 3,850,745 | 11/1974 | Ellender, Jr. | 208/226 |
| 3,948,759 | 4/1976 | King et al. | 208/248 |
| 3,971,713 | 7/1976 | Ellender, Jr. | 208/226 |
| 4,087,348 | 5/1978 | Baird, Jr. et al. | 208/226 |
| 4,305,804 | 12/1981 | Chen et al. | 208/226 |
| 4,376,032 | 3/1983 | Givens | 208/247 |
| 4,571,455 | 2/1986 | Slaugh | 208/226 |

*Primary Examiner*—H. M. S. Sneed
*Assistant Examiner*—Helane Myers
*Attorney, Agent, or Firm*—Frost & Jacobs

[57] ABSTRACT

A method is proposed for the desulphurization of sulphur-containing fuels in which the fuels are mixed with at least one solid basic additive and at least one metal in finely divided form, the mixture thus obtained subjected to a pyrolysis and the sulphur adsorptively or chemically bonded to the basic additive separated by methods known per se. The method is particularly suitable for the desulphurization of heavy fuel oil or used oil, and as solid basic additive preferably lime and as metal preferably iron powder are used. The permanent gas forming in the pyrolysis and the simultaneously forming condensate may be directly fired as low-sulphur fuel.

8 Claims, No Drawings

METHOD FOR THE DESULPHURIZATION OF SULPHUR-CONTAINING FUELS AND FUEL DESULPHURIZED BY SAID METHOD

FIELD OF THE INVENTION

The invention relates to a method for the desulphurization of sulphur-containing fuels and a fuel desulphurized by said method.

BACKGROUND OF THE INVENTION

The fossil fuels today mainly burnt in particular in industrial uses, for example in power stations, large-scale furnace plants, refuse incinerating plants, etc., contain sulphur in elemental and bonded form. Crude oil contains between about 0.2 and 7% by weight sulphur. In the distillation and refining of crude oil, the sulphur concentration is highest in the heavy fractions and in the residues. Heavy fuel oil can contain between 1.5 and 7% by weight sulphur with, between 10 and 22% of the sulphur contained therein being bonded to asphaltenes.

Enormous efforts have already been made to limit the sulphur dioxide content of the air, which originates to a considerable extent from combustion plants operated with fossil fuels. However, these efforts were mainly directed towards desulphurizing the flue gases formed in the combustion. Although today flue gas desulphurization apparatuses operating with good efficiency exist, they have however the disadvantage of being extremely expensive. The principle employed, i.e. first burning the sulphur to form sulphur dioxide which is extremely dangerous to the environment and then tediously the pollutants thus generated, is fundamentally very unsatisfactory. Compared therewith, it appears more reasonable to try to bond the sulphur before burning the fuels so that the gaseous pollutants do not form in the first place, or at least try to minimize as far as possible the amount of gaseous pollutants, in particular sulphur dioxide.

In his article "Experiments On Desulphurization Before and After the Burner for Reducing the $SO_2$ Output" (Mitt. der VGB, no. 83, p. 74–82, April 1963), K. Wickert gives an excellent summary of the desulphurization methods hitherto employed. However, the method described therein for desulphurization prior to the burner also operates in the gas phase, i.e. is effectively a gas purifying method which requires expensive apparatus and a large amount of space. In this known desulphurization prior to the burner (cf. loc. cit. p. 80–82), the fuel, in the specific case residual oils, is gasified by a partial burning at 1000° to 1200° C. The hot combustion gases are then desulphurized with a solid basic additive, that is CaO or $CaCO_3$, to form CaS, thereafter dedusted and then supplied to a gas burner. However, a problem with this oil gasification by partial burning is the carbon black which forms. For this reason, CaO and MgO are used as desooting catalysts which react with the water vapour forming in the partial combustion step carbon monoxide and hydrogen. Of course, the CO must not be allowed to enter the environment any more than the $SO_2$, and for this reason it must therefore be washed out of the flue gases again or oxidized to $CO_2$.

This known desulphurization method is too complicated and too expensive for the conversion of old combustion plants fired predominantly with heavy fuel, and the installation of the desulphurization and dedusting apparatus necessary for this purpose is frequently not possible for the simple reason that no space is available.

SUMMARY OF THE INVENTION

It is, therefore, an object of this invention to meet the existing great need for a simple and economical method for the desulphurization of sulphur-containing fuels and provide a method which permits not only an effective bonding of the sulphur contained in fossil fuels but also can be carried out with relatively small investment costs and space requirements and is thereby particularly suitable for the conversion of existing heating and combustion plants fired with heavy fuel oil.

DETAILED DESCRIPTION OF THE PREFERRED EMBODIMENTS

Thus, the problems mentioned are solved according to this invention in that the fuels are mixed (a) with at least one solid basic additive and (b) with at least one metal in finely divided form. The mixture is subjected to a pyrolysis and the sulphur absorption or chemical bonding to the basic additive is separated by methods known per se.

This achieves a desulphurization before the burner which does not require any partial combustion. Thus, any oil gassification with subsequent gas purification by wet washing or by blowing in solid basic additives reresents a true abandonment of the previously applied principle, in which the pollutants were first produced and then eliminated. The essence of the method according to the invention resides in the sulphur content of the fuel prior to the firing is reduced as much as possible, so that only the minimum possible amount of gaseous sulphur compounds, in particular $SO_2$ but also $H_2S$, is formed in the first place. The materials to be added to the fuel according to the invention, basic additives and finely divided metal, are cheap and availale in unlimited amounts. By the combination of the addition of solid basic additives and finely divided metal with the pyrolysis known above, all from refuse disposal an effective bonding of the sulphur contained in the fuel is achieved.

The particular pyrolysis differs from combustion methods in that it operates at comparatively low temperatures of preferably below 1000° C. in a reducing atmosphere with complete exclusion of oxygen as possible. Under the pyrolysis conditions, hydrogen is formed which reduces the elemental sulphur contained in the fuel and the organic and inorganic sulphur compounds contained therein to hydrogen sulphide. Since the acidity of the hydrogen sulphide is considerably higher than that of the inorganic and organic sulphur compounds contained in the fuel, the bonding of the sulphur, by reacting $H_2S$ with the solid basic additives, takes place more rapidly, more completely and thus more effectively.

The reduction of the sulphur compounds contained in the fuel and of the elemental sulphur contained therein is supported in a synergistic manner, according to the invention, by the addition of at least one metal in finely divided form. The finely divided metal acts, on the one hand, catalytically, i.e. catalyzes the reaction of the hydrogen forming in the pyrolysis with the sulphur compounds. the other hand its represents for elemental sulphur and for bonded sulphur a reducing agent, the metal being oxidized and the sulphur reduced to the sulphidic form.

Preferably, according to the invention, a metal is added which forms particularly sparingly soluble solid sulphides so that the sulphur compounds cannot be washed out of the solid residue. The residue forms in the pyrolysis along with permanent gas and condensate and cannot volatilize. The pyrolysis residue containing the sparingly soluble solid sulphides can thus be stored without any problems in suitable dumps and also be easily transported without risk. The most frequent sulphur compounds contained in the fuel are mercaptans, sulphides and cyclic sulphur compounds such as thiophene. All these sulphur compounds, including those bonded to asphaltenes, are surprisingly substantially and effectively bonded in sulphidic form to the solid basic additives by the method according to the invention. The separation of the sulphur, bonded adsorptively or chemically to the basic additives, from the now desulphurized fuel is done in a known manner, either mechanically, or by sorting, or by any other physical or chemical methods.

The solid basic additive, according to the invention, includes at least one carbonate, hydrogen carbonate, hydroxide and/or oxide of the alkaline or alkaline earth metals, or of aluminium and/or a mineral in finely divided form containing the aforementioned substances. Particularly advantageous are lime and/or limestone. Further examples of such solid basic additives are $Ca(OH)_2$, $Al_2O_3$, dolomite, MgO, CaO and the like.

According to the invention the finely divided metal includes at least one metal of the group Mg, Ca, Fe, Co, Ni, Zn, Cd, Al, Sn, Pb, and particularly in the form of powders or chips. The simplest and cheapest to use are iron powder, iron chips and/or iron filings, especially since these are available in practically unlimited amounts as waste materials from the metal processing industries.

According to the invention any fossil fuel may be used, irrespective of whether it is in its native form, or in an already refined or processed form, as well as any other fuel, including fuel waste. Preferably, heavy fuel oil and/or used oil is employed as fuel.

The pyrolysis may be carried out under the conditions known per se, preferably at a temperature of between 500° and 1200° C., a temperature of between 600° and 900° C. being particularly preferred. The apparatus in which the pyrolysis is carried out is also known to the expert; preferably an indirectly heated rotary furnace is used.

The permanent gas forming during the pyrolysis of the mixture of fuel, basic additive and finely divided metal, and the condensate forming at the same time may, according to the invention be used as directly burnable low-sulphur fuel. If oil is used as fuel, the major part of the desulphurized oil is in the condensate of the pyrolysis. In contrast, in the pyrolysis residue, also called pyrolysis coke, there is the sulphur adsorptively or chemically bonded to the basic additive.

The invention will be further explained with the aid of the following example:

EXAMPLE 1 kg of heavy fuel oil having a density of 1.20 g/cm$^3$, a lower calorific value ($H_U$) of 40000 kJ/kg, a sulphur content of 2.82% by weight, an asphaltene content of 9.4% by weight, and an ash content of 0.6% by weight (oxide ash) is pyrolyzed together with 80 g of iron powder and 60 g of lime (CaO) in an indirectly heated rotary furnace at a temperature of 850° C. The residence time in the furnace is 25–45 min. After expiration of this time, 90 l of permanent gas, 780 g of condensate and 90 g of solid residue have formed (after taking away the additives). The condensate had a density of 0.94 g/cm$^3$, a lower calorific value ($H_U$) of 38000 kJ/kg, a sulphur content of 0.35% by weight, and an asphaltene content of 2.6% by weight and an ash content (oxide ash) of 0.01% by weight. The sulphur content of the heavy fuel oil after carrying out the method according to the invention was thus only 12.4%, the asphalt content 27.7% and the ash content 1.7% of the original contents. The permanent gas obtained in this manner and the condensate were supplied to a conventional oil gasification burner and fired directly.

I claim:

1. A method for the desulphurization of sulphur containing fuels selected from the group consisting of heavy fuel oil, used oil, and mixtures thereof, comprising mixing the fuel with (a) at least one solid basic additive selected from the group consisting of carbonate, hydrogen carbonate, hydroxides of alkali metals, hydroxides of alkaline earth metals, aluminium hydroxide, oxides of alkali metals, oxides of aklaline earth metals and aluminium oxide, employed in finely divided form; and (b) at least one elemental metal in finely divided form selected from the group consisting of Mg, Ca, Fe, Co, Ni, Zn, Cd, Al, Sn and Pd; said metal being present in greater amount than said basic additive; and subjecting the mixture so formed to pyrolysis at a temperature between 500° and 1200° C. to produce hydrogen which reduces elemental sulphur and sulphur containing compounds to hydrogen sulphide, whereby said fuel yields a permanent gas portion, a condensate portion and a residue portion, said residue portion containing said reduced sulphur while said permanent gas portion and condensate portion are substantially sulphur free, and removing said residue sulphur containing portion from said condensate portion and said permanent gas portion.

2. The method according to claim 1, wherein said oxide of alkaline earth metals is lime.

3. The method according to claim 1, wherein said carbonate is limestone.

4. The method according to claim 1, wherein said finely divided metal is in the form of powder.

5. The method of claim 1, wherein said finely divided metal is in the form of chips.

6. The method according to claim 1, wherein said finely divided metal is in the form of filings.

7. The method according to claim 1, wherein said metal comprises iron in the form selected from the group consisting of iron powder, iron chips and iron filings.

8. The method according to claim 1, wherein said pyrolysis is carried out in an indirectly heated rotary furnace at a temperature of between 600° and 900° C.

* * * * *